US011505431B2

(12) United States Patent
Kato et al.

(10) Patent No.: US 11,505,431 B2
(45) Date of Patent: Nov. 22, 2022

(54) CLEANING DEVICE FOR AN ELEVATOR SYSTEM

(71) Applicant: Otis Elevator Company, Farmington, CT (US)

(72) Inventors: Mitsuru Kato, Inzai (JP); Hirotomo Tanaka, Chiba (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 546 days.

(21) Appl. No.: 16/590,704

(22) Filed: Oct. 2, 2019

(65) Prior Publication Data

US 2021/0101784 A1 Apr. 8, 2021

(51) Int. Cl.

| | |
|---|---|
| ***B66B 7/12*** | (2006.01) |
| ***B08B 1/02*** | (2006.01) |
| ***B66B 19/00*** | (2006.01) |

(52) U.S. Cl.

CPC ..... *B66B 7/1284* (2013.01); *B08B 1/02* (2013.01); *B66B 7/1276* (2013.01); *B66B 19/00* (2013.01)

(58) Field of Classification Search

CPC ..... B66B 7/1284; B66B 7/1276; B66B 19/00; B66B 31/003; B08B 1/02

See application file for complete search history.

(56) References Cited

U.S. PATENT DOCUMENTS

| | | | | |
|---|---|---|---|---|
| 5,036,563 | A * | 8/1991 | Liebing | B08B 1/02 198/496 |
| 5,386,882 | A * | 2/1995 | Friend | A46B 15/00 184/15.3 |
| 5,784,752 | A * | 7/1998 | Barrett | B65G 45/18 15/88 |
| 7,665,179 | B2 * | 2/2010 | Connolly | B66B 7/1284 15/88 |
| 8,955,649 | B2 * | 2/2015 | Yokobayashi | B66B 7/1292 15/88.1 |
| 2004/0134757 | A1 * | 7/2004 | DeVries | B65G 45/16 198/497 |
| 2005/0217058 | A1 * | 10/2005 | Connolly | B08B 1/008 15/256.6 |
| 2007/0044267 | A1 * | 3/2007 | Connolly | B66B 7/1284 198/496 |
| 2020/0239281 | A1 * | 7/2020 | Grainger | B66B 15/04 |

FOREIGN PATENT DOCUMENTS

| | | | |
|---|---|---|---|
| EP | 1528027 | A1 | 5/2005 |
| JP | S61130578 | U | 8/1986 |
| JP | H05105365 | A | 4/1993 |
| JP | 2012240836 | A | 12/2012 |
| JP | 2016117540 | A | 6/2016 |

OTHER PUBLICATIONS

European Search Report for Application No. 20199953.9, dated Feb. 15, 2021, 9 Pages.

* cited by examiner

*Primary Examiner* — Jeffrey Donels
(74) *Attorney, Agent, or Firm* — Cantor Colburn LLP

(57) ABSTRACT

According to one embodiment, a cleaning head for cleaning a plurality of hoisting belts and/or at least one sheave of an elevator system is provided. The at least one sheave includes a plurality of grooves for receiving each of the hoisting belts. The cleaning head comprises a base plate and a plurality of wipers fixed to an upper end of the base plate to project outwards from the base plate. The cleaning head may be used to clean the plurality of hoisting belts at once and/or the plurality of grooves of the at least one sheave at once.

18 Claims, 9 Drawing Sheets

CLEANING DEVICE FOR AN ELEVATOR SYSTEM

BACKGROUND

This invention generally relates to a device for in situ cleaning of belts and/or sheaves of an elevator system.

Many elevator systems include an elevator car and counterweight that are suspended within a hoistway by roping comprising one or more hoisting ropes. Typically, wire ropes, cables or belts are used as the hoisting ropes for supporting the weight of the elevator car and counterweight and for moving the elevator car to desired positions within the hoistway. The hoisting ropes are typically routed about several sheaves according to a desired roping arrangement.

Belts used as hoisting ropes typically include a plurality of longitudinally extending wire cords and a jacket covering the wire cords. In an elevator system which uses such belts as the hoisting ropes, foreign material such as dust or dirt that may be found in the elevator hoistway may adhere to the surface of the belts during installation or normal operation. Such foreign material may cause undesirable noise leading to complaints from building residents or owners. Further, during normal operation, wax on the surface of the belts adheres to the surface of the sheaves upon contact of the belts with the sheave. This causes slippage between the belts and the sheaves which may impair accurate movement of the elevator car. Therefore, the belts and sheaves must be cleaned on a regular basis.

One cleaning device for an elevator belt is shown in Japanese Patent Application Publication No. 2016-117540. This patent application discloses a cleaning device which sandwiches the belts between a pair of pad units. Such cleaning device is heavy and requires much time to install and to adjust.

On the other hand, sheaves are currently cleaned by hand. Such manual cleaning is both labor intensive and time consuming and may be dangerous since the belts are usually moved during cleaning.

In view of the above and other considerations, there is a need for an efficient cleaning device for cleaning belts and/or sheaves of an elevator system.

BRIEF SUMMARY

According to one embodiment, a cleaning head for cleaning a plurality of hoisting belts and/or at least one sheave of an elevator system, the at least one sheave including a plurality of grooves for receiving each of the hoisting belts, comprises a base plate and a plurality of wipers fixed to an upper end of the base plate to project outwards from the base plate, wherein the cleaning head may be used to clean the plurality of hoisting belts at once and/or the plurality of grooves of the at least one sheave at once.

In addition to one or more of the features described above, or as an alternative, further embodiments may be included wherein the number of wipers corresponds to the number of hoisting belts.

In addition to one or more of the features described above, or as an alternative, further embodiments may be included wherein the width of each wiper corresponds to the width of each hoisting belt and the spacing between the wipers corresponds to the spacing between the hoisting belts.

In addition to one or more of the features described above, or as an alternative, further embodiments may be included wherein the upper end of the base plate is bent at an angle A with respect to the rest of the base plate, and wherein the wipers are each sandwiched between the upper end of the base plate and respective fixing plates bolted onto the upper end of the base plate so that the wipers project outwards from the base plate at the angle A.

In addition to one or more of the features described above, or as an alternative, further embodiments may be included wherein the angle A is about 40 to 50 degrees.

In addition to one or more of the features described above, or as an alternative, further embodiments may be included wherein the lower end of the base plate includes at least one open slot.

In addition to one or more of the features described above, or as an alternative, further embodiments may be included wherein each of the wipers comprise an elastic plate and a cleaning sheet wrapped around the elastic plate.

In addition to one or more of the features described above, or as an alternative, further embodiments may be included wherein the at least one sheave is a drive sheave.

In addition to one or more of the features described above, or as an alternative, further embodiments may be included wherein the at least one sheave is an idler sheave.

According to another embodiment, a cleaning device for cleaning a plurality of hoisting belts and/or at least one sheave of an elevator system, the at least one sheave including a plurality of grooves for receiving each of the hoisting belts, comprises an attachment plate which may be fixed to a machine casing, at least one L-shaped first bracket which may be adjustably fixed to the attachment plate, at least one L-shaped second bracket which may be adjustably fixed to the first bracket, and a cleaning head which may be fixed to the second bracket. The cleaning head includes a base plate and a plurality of wipers fixed to an upper end of the base plate to project outwards from the base plate, wherein the cleaning head is positioned to clean the plurality of hoisting belts at once and/or the plurality of grooves of the at least one sheave at once.

In addition to one or more of the features described above, or as an alternative, further embodiments may be included wherein the first and second brackets are placed in alignment with the space between the plurality of hoisting belts, and the at least one second bracket extends through said space, when the cleaning device is installed in the elevator system.

In addition to one or more of the features described above, or as an alternative, further embodiments may be included wherein the cleaning device is installed such that the wipers project toward the inner surface of the hoisting belts to apply an adequate pressure thereon.

In addition to one or more of the features described above, or as an alternative, further embodiments may be included wherein the cleaning device is installed such that the wipers project toward the traction sheave to apply an adequate pressure on the bottom of each groove of the traction sheave.

In addition to one or more of the features described above, or as an alternative, further embodiments may be included further comprising a supporting plate fixed on the side of the cleaning head opposite the second bracket to support the cleaning head during operation.

In addition to one or more of the features described above, or as an alternative, further embodiments may be included wherein the first bracket includes an elongate slot for receiving at least one bolt which allows adjustment of the first bracket in a vertical direction with respect to the attachment plate.

In addition to one or more of the features described above, or as an alternative, further embodiments may be included wherein the second bracket includes an elongate slot for receiving at least one bolt which allows adjustment of the second bracket in a back and forth direction with respect to the first bracket.

According to another embodiment, a method for installing a cleaning device in an elevator system comprises fixing an attachment plate and at least one L-shaped first bracket to a machine casing, fixing at least one L-shaped second bracket to the first bracket, fixing a cleaning head to the second bracket, the cleaning head including a base plate and a plurality of wipers fixed to an upper end of the base plate to project outwards from the base plate, and adjusting the first bracket and the second bracket so that the cleaning head applies an adequate pressure to a plurality of hoisting belts at once or to a plurality of grooves of at least one sheave at once.

In addition to one or more of the features described above, or as an alternative, further embodiments may be included further comprising aligning the first and second brackets with the space between the plurality of hoisting ropes and inserting the at least one second bracket through said space.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several Figs.

DETAILED DESCRIPTION

Figure 1:
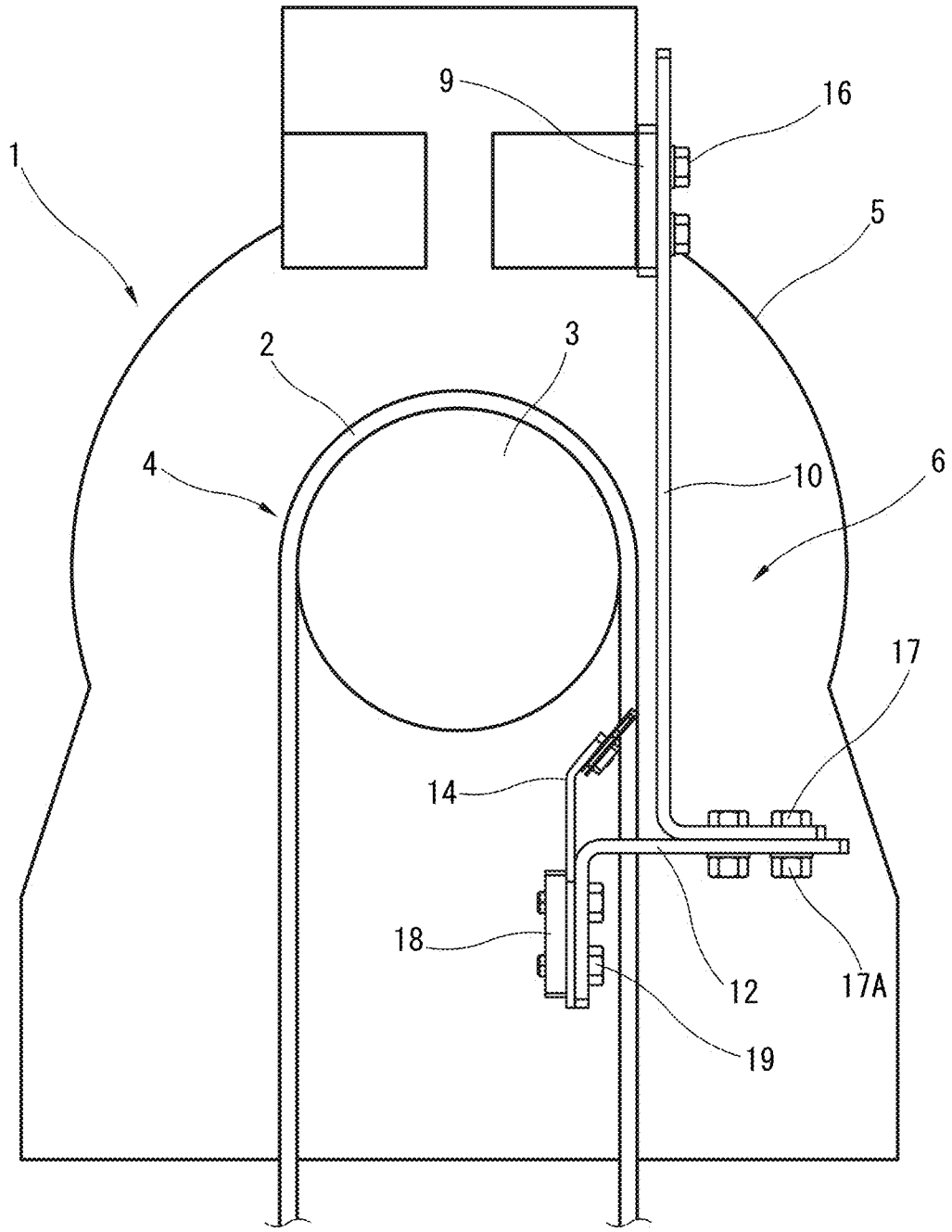
FIG. 1 illustrates a schematic view of part of an exemplary elevator system including a cleaning device of the present invention installed to clean belts.

FIG. 1 schematically illustrates selected portions of an example elevator system 1. A plurality of belts 2 extends over a traction sheave 3 with one end connected to an elevator car (not shown) and the other end connected to a counterweight (not shown). The traction sheave 3 is driven by a machine 4 which may be positioned in a machine case 5 and disposed in a machine room (not shown). Traction between the traction sheave 3 and the belts 2 drive the car and the counterweight vertically through a hoistway (not shown). The plurality of belts 2 are aligned in parallel and are equally spaced apart. The traction sheave 3 includes a plurality of grooves (not shown) on the outer surface thereof for receiving each of the belts 2. The bottom of the grooves provide a traction surface for each of the belts 2.

Each of the belts 2 may comprise one or a plurality of longitudinally extending wire cords embedded within a jacket having a flat rectangular cross section. The wire cords may each comprise a plurality of steel wires and the jacket may comprise a flexible synthetic resin material such as a polyurethane resin. However, the belts 2 may comprise any other material as long as it is capable of supporting the weight of the elevator car and counterweight and moving the elevator car to desired positions within the hoistway.

Figure 2:
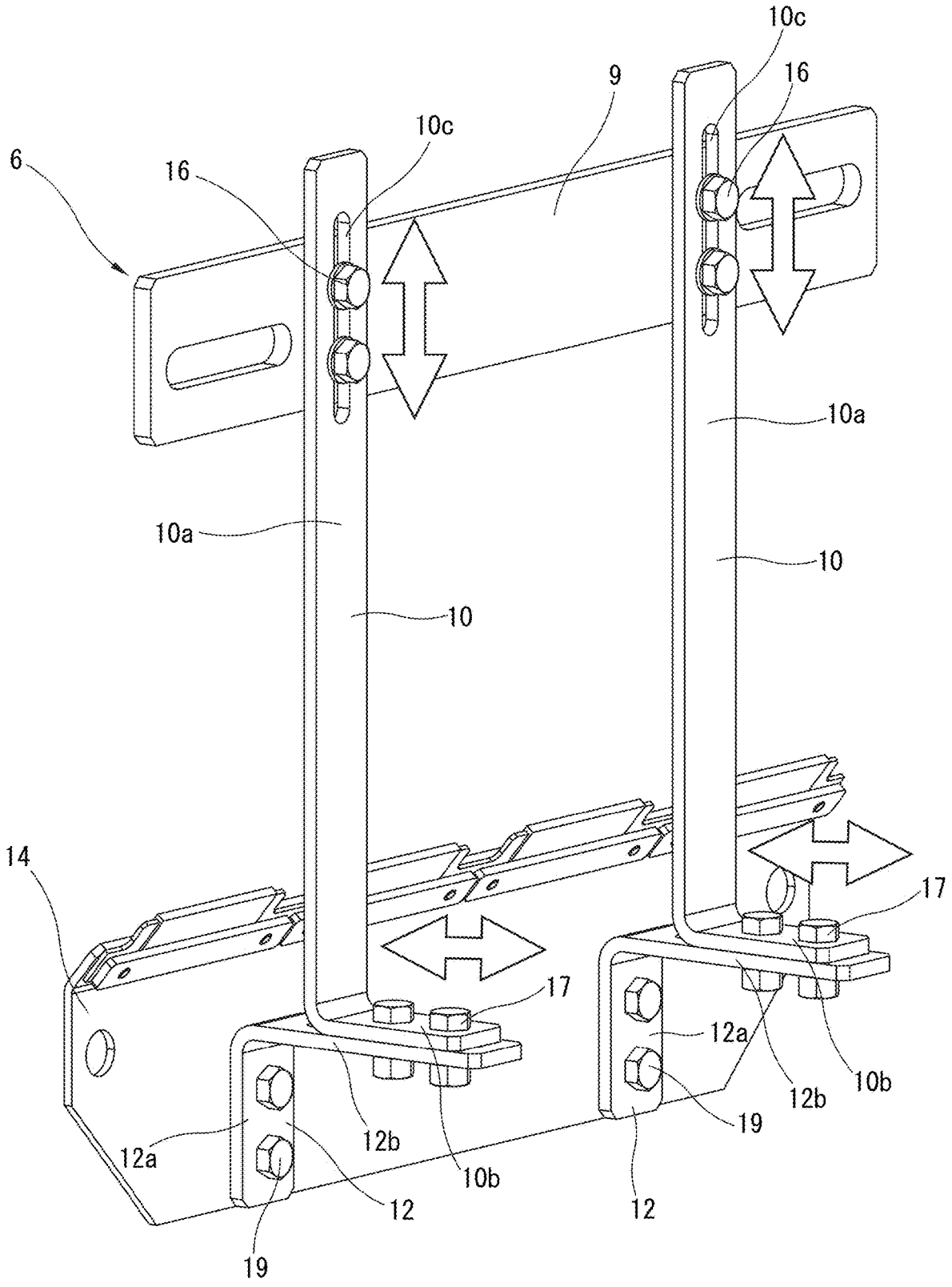
FIG. 2 illustrates a perspective view of the cleaning device of FIG. 1.

FIG. 1 further shows a cleaning device 6 of the present invention. Also referring to FIG. 2, the cleaning device 6 comprises an attachment plate 9, a pair of L-shaped first brackets 10, a pair of L-shaped second brackets 12 and a cleaning head 14. The first brackets 10 are provided on both sides of the attachment plate 9 and the attachment plate 9 and the first brackets 10 are both fixed to the machine casing 5 via bolts 16. The second brackets 12 are fixed to each of the first brackets 10 via bolts 17 and nuts 17A. The cleaning head 14 is fixed to the second bracket 12 via a supporting plate 18 positioned on the side of the cleaning head 14 opposite the second bracket 12. The supporting plate 18 is bolted onto the second bracket 12 via bolts 19 and supports the cleaning head 14 during operation. In this embodiment, the cleaning head 14 is positioned to clean the plurality of belts 2 at once.

The attachment plate 9 extends in a lateral direction parallel to the traction sheave axis. The L-shaped first bracket 10 comprises a first leg 10*a* and a second leg 10*b* extending at a right angle from the first leg 10*a*. The distal end of the first leg 10*a* includes an elongated slot 10*c* for receiving bolts 16 which allows adjustment of the first bracket 10 in the vertical direction with respect to the attachment plate 9, as shown by arrows. The first leg 10*a* extends vertically downward from the attachment plate 9 and the second leg 10*b* extends in a direction away from the traction sheave 3.

The L-shaped second bracket 12 comprises a first leg 12*a* fixed to the cleaning head 14 and a second leg 12*b* extending at a right angle from the first leg 12*a*. The second leg 12*b* is fixed to the second leg 10*b* of the first bracket 10 via bolts 17 and nuts 17A. The distal end of the second leg 12*b* of the second bracket 12 includes an elongate slot (not shown) for receiving bolts 17 which allows adjustment of the second bracket 12 and thus the cleaning head 14 in the back and forth direction with respect to the first bracket 10 (the left/right direction in FIG. 1), as shown by arrows.

Figure 3:
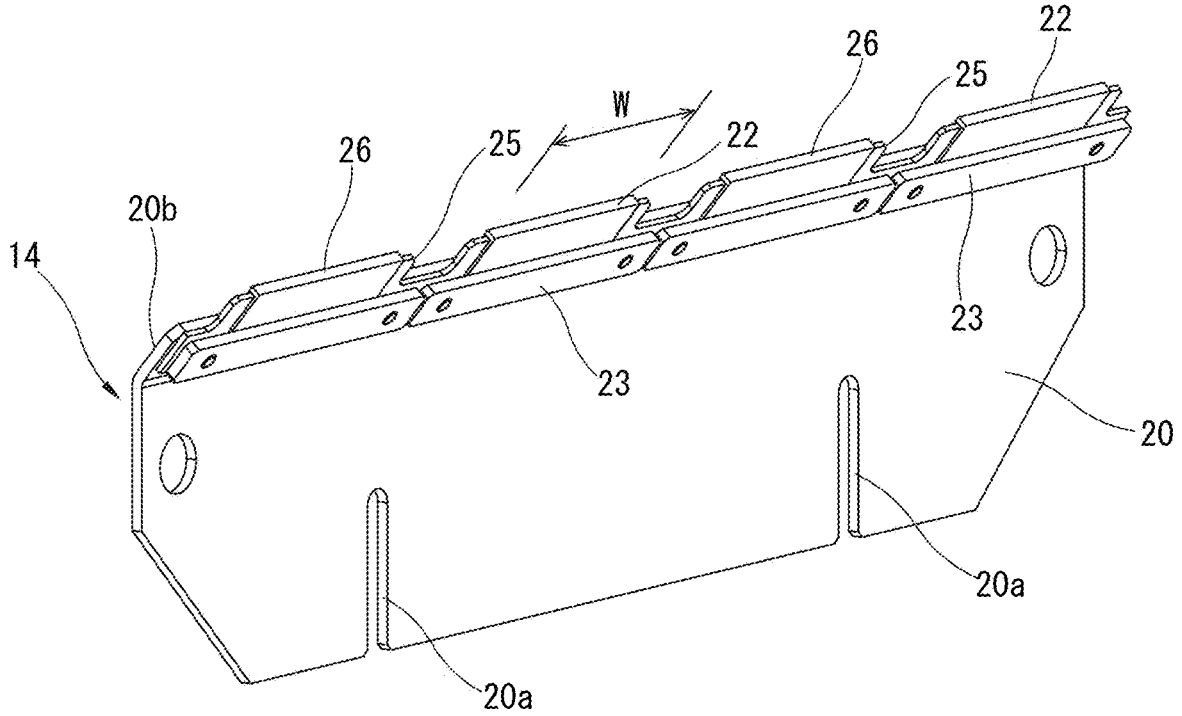
FIG. 3 illustrates a cleaning head of the cleaning device of FIG. 2.
Figure 4:
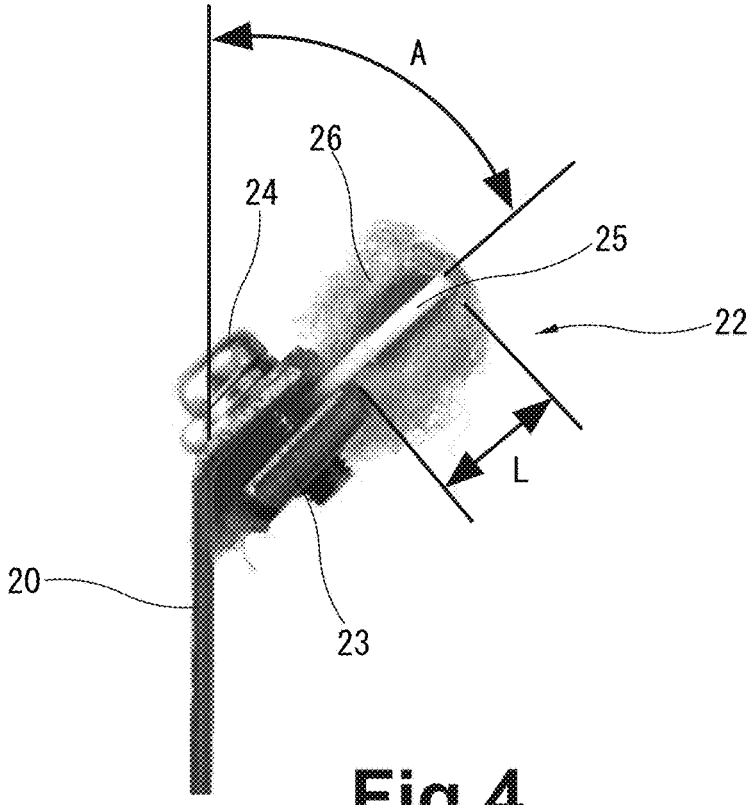
FIG. 4 illustrates a partial side view of the cleaning head of FIG. 3.

FIG. 3 is an enlarged view of the cleaning head 14 and FIG. 4 is a partial side view of the cleaning head 14. The cleaning head 14 comprises a base plate 20 which is a rectangular plate with chamfered bottom corners and including two open slots 20*a* for receiving bolts 19. The open slots 20*a* facilitate the attachment and removal of the cleaning head 14 and also allow adjustment of the cleaning head 14 in the vertical direction, if necessary. The upper end 20*b* of the base plate 20 is bent at an angle with respect to the rest of the base plate 20. A plurality of wipers 22 corresponding to the number of belts, which are four in this example, are each sandwiched between the upper end 20*b* of the base plate 20 and respective fixing plates 23 each fixed onto the base plate 20 by a pair of bolts 24. The wipers 22 each comprise an elastic plate 25 and a cleaning sheet 26. The base of the elastic plate 25 is sandwiched between the base plate 20 and fixing plate 23 and the tip of the elastic plate 25 protrudes from the base plate 20 by a length L. The cleaning sheet 26 is wrapped around the tip of the elastic plate 25 and sandwiched between the base plate 20 and the fixing plate 23 together with the base of the elastic plate 25. The cleaning sheet 26 has a width W corresponding to the width of each belt 2 and projects from the base plate 20 with spacing that corresponds to the distance between the belts 2. The spacing of the cleaning sheet 26 may be equally spaced or spaced at varying widths.

The cleaning sheet 26 is made of a polyester not-woven fabric, for example. The material of the cleaning sheet 26 will not damage the jacket of the belt 2 or coating on the sheave 3. In the case cleaning oil is used, the cleaning sheet 26 will retain the oil. The elastic plate 25 may be made of a polypropylene resin with a thickness of 0.75 to 1 mm, for example. The elasticity of the elastic plate 25 is selected so that it will not cause a large noise at a high frequency. The length L of the tip of the elastic plate is 10 mm, for example. The optimum angle A of the upper end 20*b* of the base plate 20 and thus the optimum angle of the elastic plate 25 with respect to the rest of the base plate 20 is 40 to 50 degrees, for example. The width W of the cleaning sheet 22 is 35 mm, for example, for 32 kN or 43 kN coated steel belts (CSB).

Figure 5:
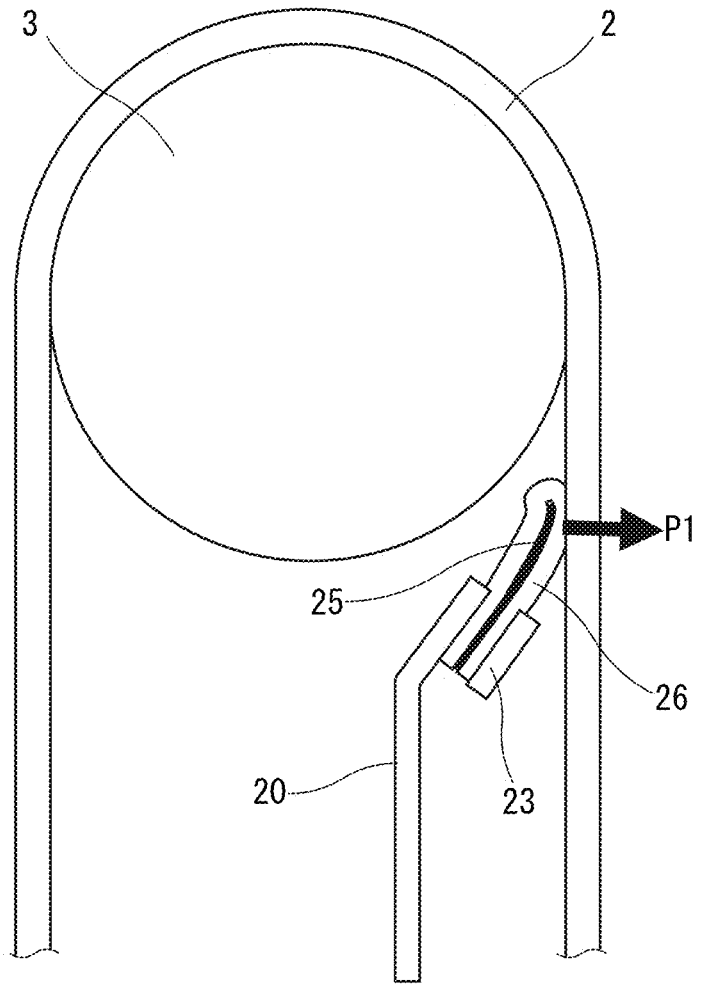
FIG. 5 illustrates a schematic view showing the cleaning head of FIG. 3 contacting a belt.

The first and second brackets 10, 12 are placed in alignment with the space between the belts 2. This allows a mechanic to insert the second brackets 12 between the belts 2 and to place the wipers 22 of cleaning head 14 to contact the inside surface of the belt 2, i.e., the side of the belt facing the traction sheave 3, as shown in FIG. 5. The brackets 10, 12 are adjusted such that an adequate pressure P1 is applied to the belt surface to wipe off foreign material such as dust or dirt that may adhere to the surface of the belts during installation or normal operation of the elevator system. The elasticity of the elastic plate 25 also contributes to apply such pressure P1. After such adjustment, the traction sheave 3 is rotated in either a clockwise or counterclockwise direction.

Figure 6:
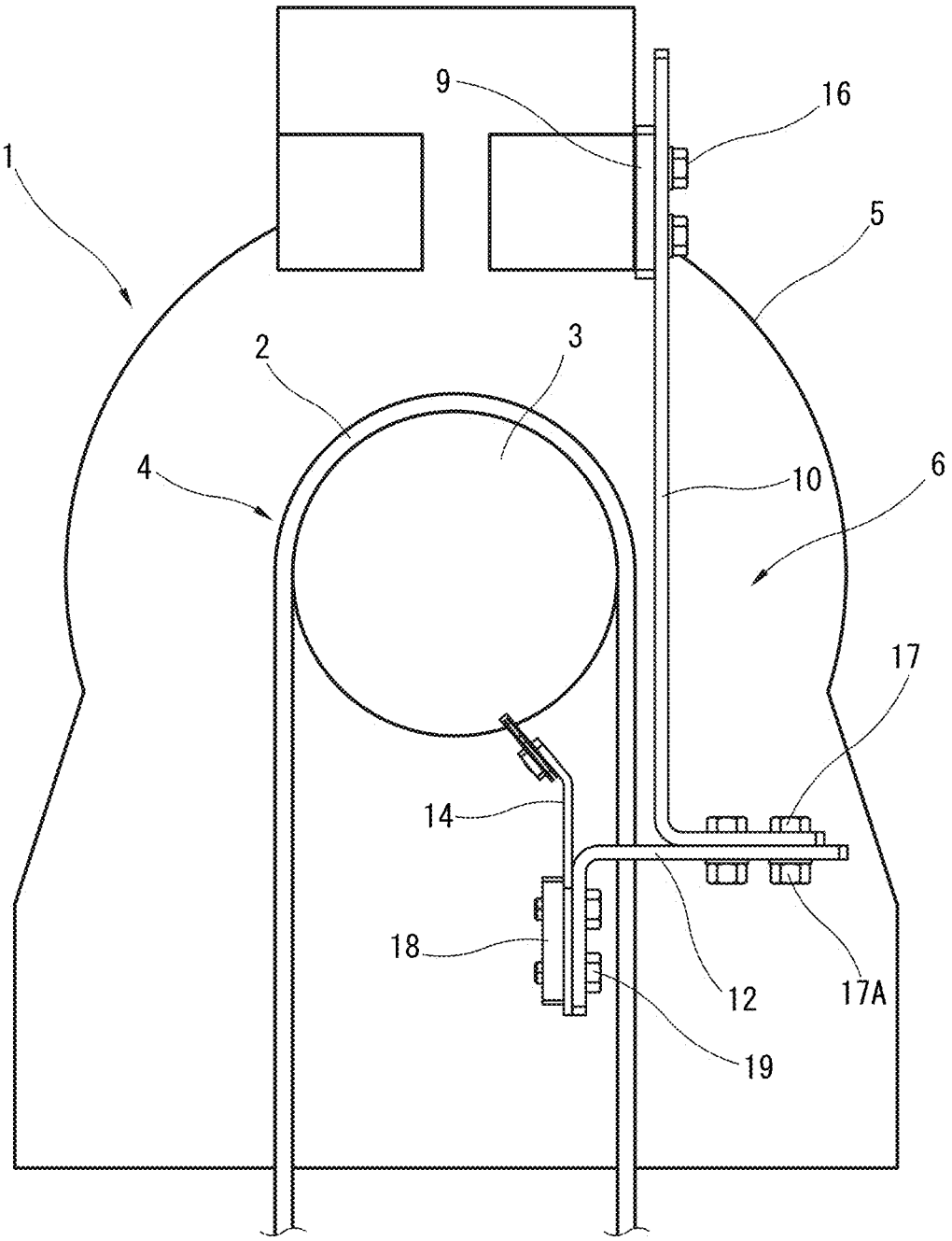
FIG. 6 illustrates a schematic view of part of an exemplary elevator system including the cleaning device of the present invention installed to clean the traction sheave.
Figure 7:
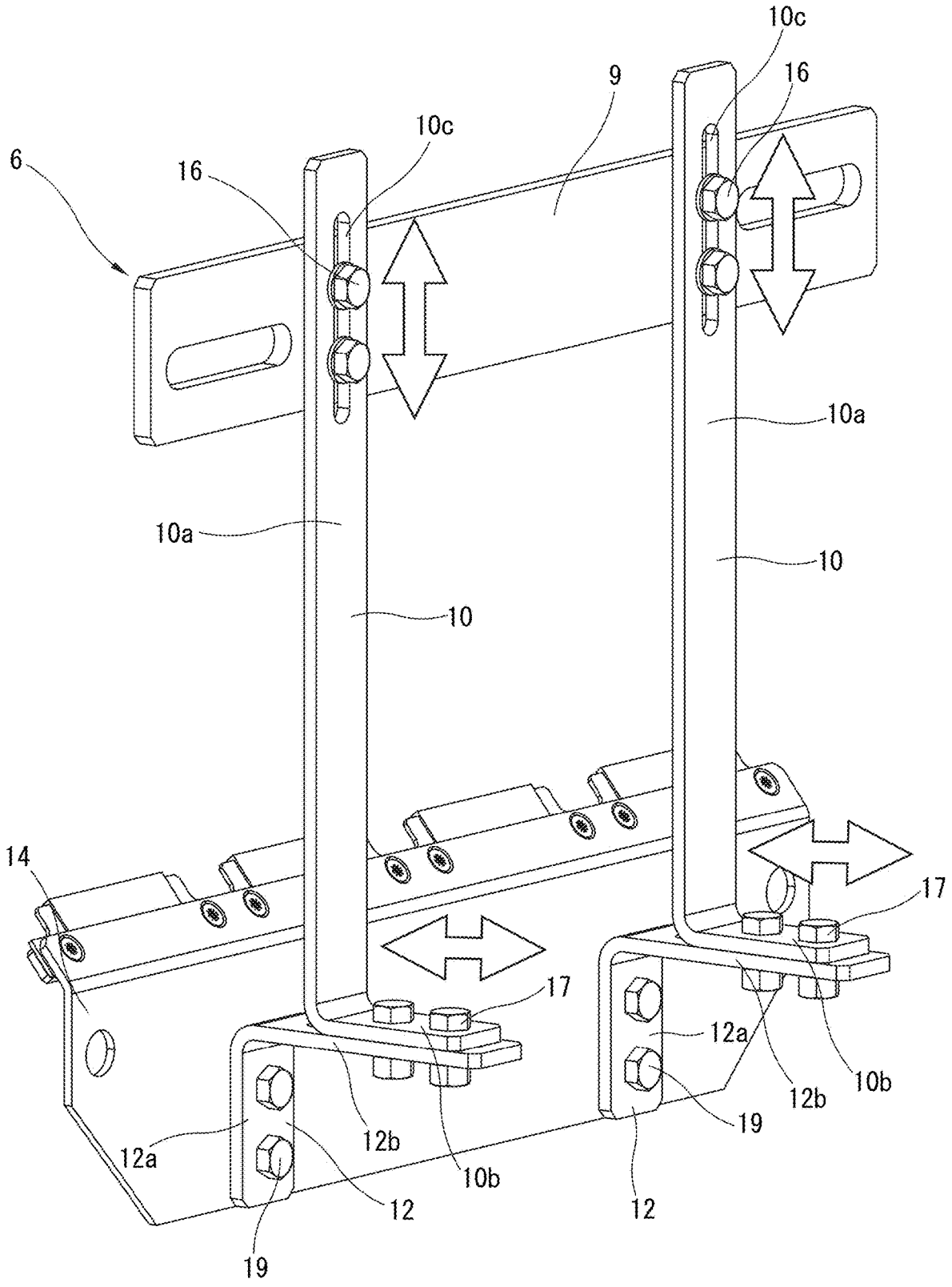
FIG. 7 illustrates a perspective view of the cleaning device of FIG. 6.
Figure 8:
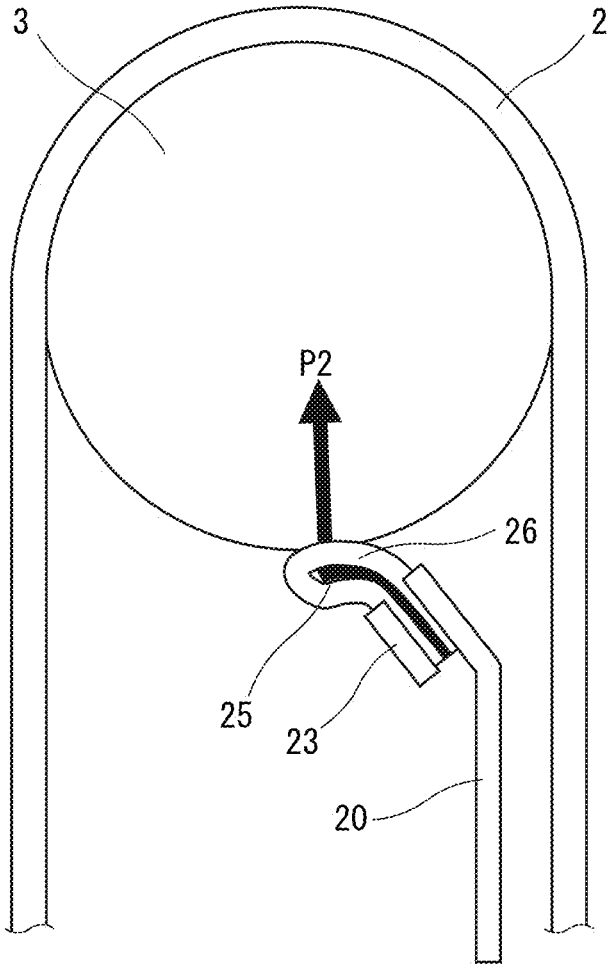
FIG. 8 illustrates a schematic view showing the cleaning head of FIG. 3 contacting a traction sheave.

The above configuration of the brackets 10, 12 also enables the cleaning device 6 to be used to clean the grooves of the traction sheave 3, such as shown in FIGS. 6 to 8. The cleaning device 6 may be used to clean all the grooves of the traction sheave 3 at once. In order to clean the grooves of the traction sheave 3, the cleaning head 14 is fixed to the second bracket 12 so that the wipers 22 project toward the traction sheave 3, i.e., in a direction opposite the direction the wipers 22 project when cleaning the belt. The brackets 10, 12 are adjusted such that an adequate pressure P2 is applied to the bottom of the grooves on the traction sheave 3, which provide a traction surface for the belts 2, to wipe off wax that may adhere to the bottom of the grooves upon contact with the belt. After such adjustment, the traction sheave 3 is rotated in either a clockwise or counterclockwise direction.

Referring again to FIGS. 1, 2, 6 and 7, to clean the belt 2 and/or the sheave 3, the cleaning device 6 may be installed in the elevator system 1 such as during maintenance. After installation and adjustment of the cleaning device 6, the elevator system 1 may be operated at an inspection speed slower than a normal operating speed so that the cleaning head 14 relatively moves against the belt and/or sheave. In this embodiment, one of the belt and sheave is cleaned at one time. However, it is possible to install the cleaning device 6 such as on both sides of the machine case 5 and clean the belt 2 and sheave 3 at once.

The cleaning device 6 may be installed by fixing the attachment plate 9 and first brackets 10 to the machine cover 5, connecting the second brackets 12 to each of the first brackets 10, and attaching the cleaning head 14 to the second brackets 12 via the supporting plate 18. The cleaning device 6 may be entirely removed from the elevator system 1 after cleaning. However, it is also possible to only remove the cleaning head 14 from the cleaning device 6 and leave the rest of the components installed in the elevator system 1. In this case, the mechanic only needs to install the cleaning head 14 upon cleaning the belt 2 or sheave 3.

Figure 9:
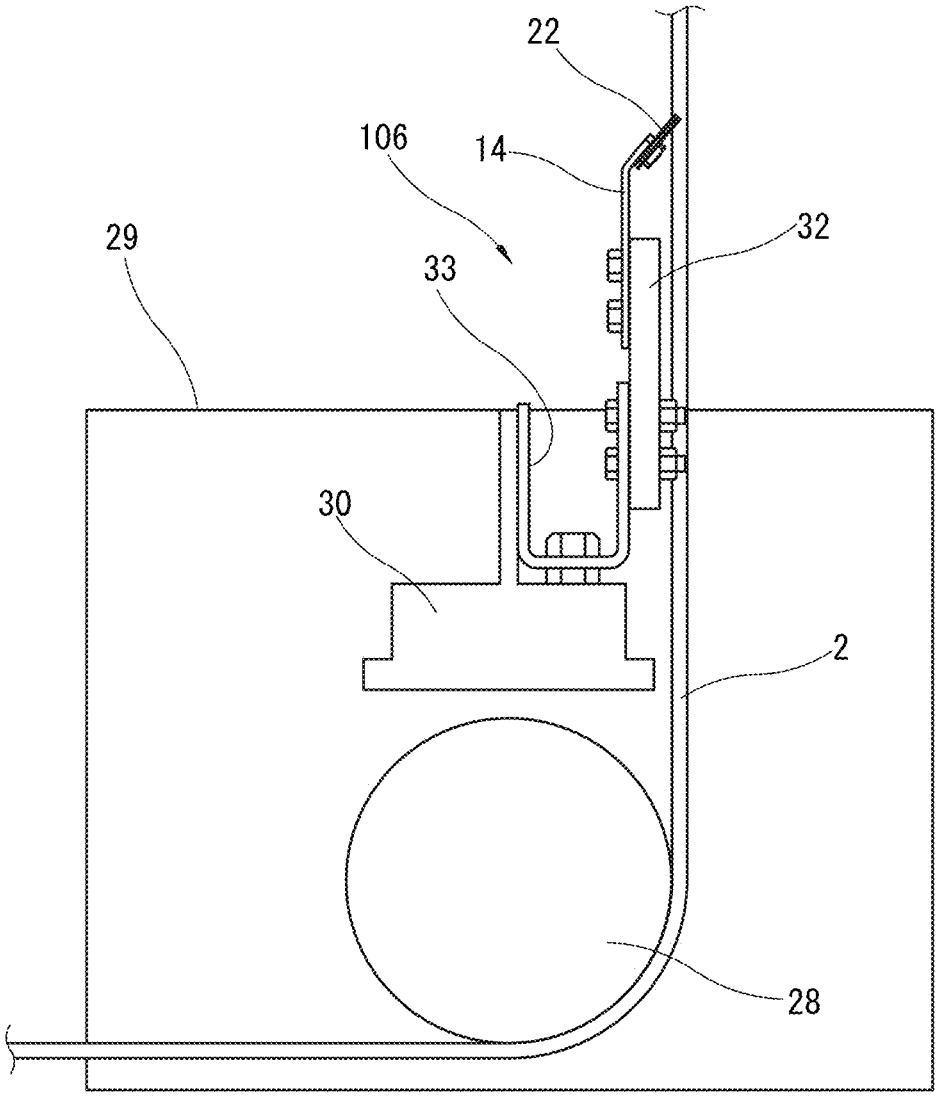
FIG. 9 illustrates a second embodiment of the cleaning device of the present invention installed to clean belts.
Figure 10:
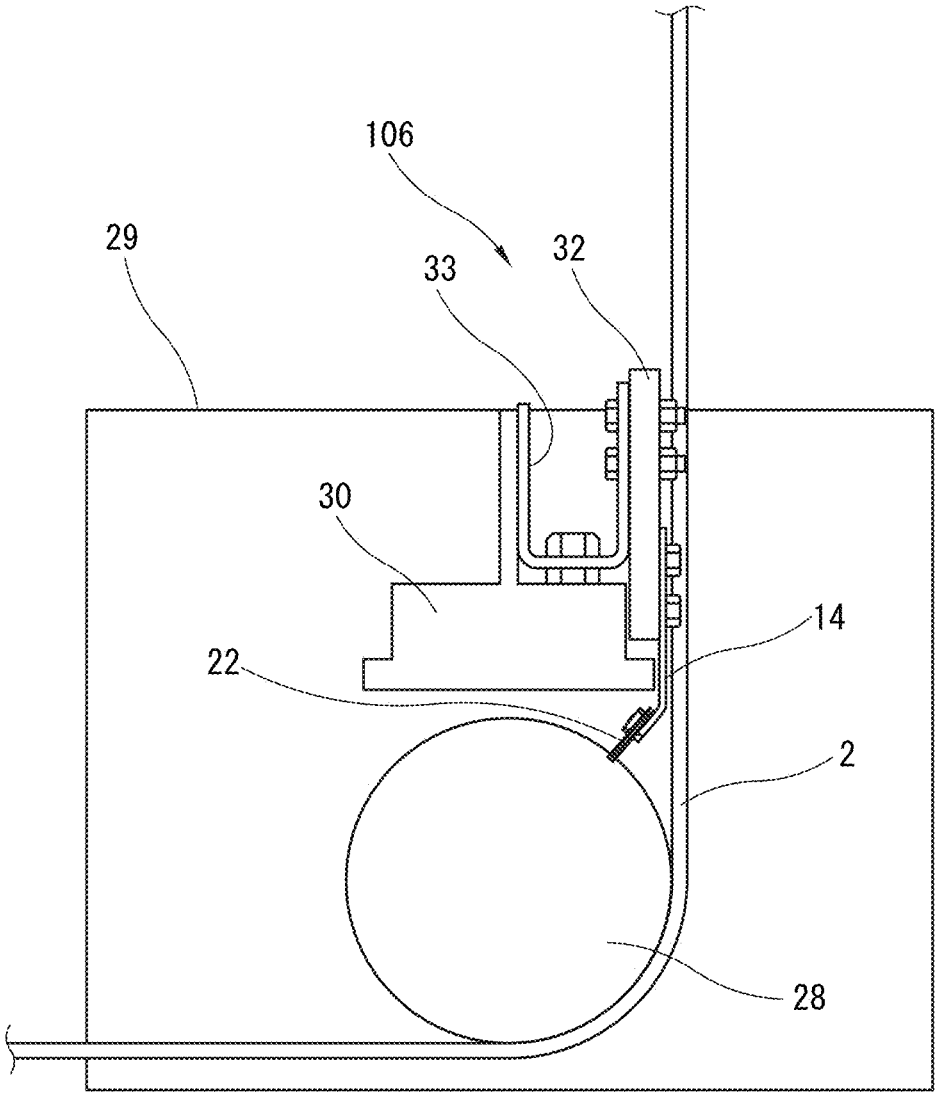
FIG. 10 illustrates a second embodiment of the cleaning device of the present invention installed to clean an idler sheave.

Another embodiment of a cleaning device 106 of the present invention for cleaning a belt 2 and/or an idler sheave 28 of an elevator system is shown in FIGS. 9 and 10. With reference to FIG. 9, the cleaning head 14 is positioned to clean the side of the belt 2 contacting the idler sheave 28 which may be the opposite side of the belt 2 cleaned in the first embodiment. The idler sheave 28 may be fixed to a structure 29 inside the hoistway or on the elevator car or counterweight via a mounting member 30. A supporting plate 32 is fixed to the mounting member 30 via a U-shaped bracket 33. The cleaning head 14 is fixed to the upper end of the supporting plate 32 so that the wiper 22 projects in the direction of the belt 2 to apply pressure P1 on the belt 2.

FIG. 10 shows the cleaning device 106 installed to clean the idler sheave 28. The supporting plate 32 is turned upside down and the cleaning head 14 is fixed to the other side of the supporting plate 32 so that the wiper 22 projects in the direction of the idler sheave 28 to apply pressure P2 on the sheave. That is, in this embodiment, both the position and orientation of the cleaning head 14 is changed depending on which member is to be cleaned, the belt or the idler sheave.

According to the present invention, a common cleaning device 6 may be used to clean both the belt 2 and the sheave 3. The cleaning device 6 is light compared to conventional cleaning devices, which makes it easy for the mechanic to carry the device to the site and to install the device. Since the operation of the cleaning device 6 is effected by the operation of the elevator system, cleaning is performed safely and efficiently. As a result, the time required to clean the belt 2 and sheave 3 will be significantly shortened by the cleaning device 6 of the present invention.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A cleaning head for cleaning a plurality of hoisting belts and/or at least one sheave of an elevator system, the at least one sheave including a plurality of grooves for receiving each of the hoisting belts, comprising:

a base plate; and a plurality of wipers fixed to an upper end of the base plate to project outwards from the base plate;

wherein the cleaning head may be used to clean the plurality of hoisting belts at once and/or the plurality of grooves of the at least one sheave at once;

wherein the number of wipers corresponds to the number of hoisting belts.

2. The cleaning head of claim 1, wherein the width of each wiper corresponds to the width of each hoisting belt and the spacing between the wipers corresponds to the spacing between the hoisting belts.

3. The cleaning head of claim 2, wherein the plurality of wipers are spaced apart by an equal spacing.

4. A cleaning head for cleaning a plurality of hoisting belts and/or at least one sheave of an elevator system, the at least one sheave including a plurality of grooves for receiving each of the hoisting belts, comprising:

a base plate; and a plurality of wipers fixed to an upper end of the base plate to project outwards from the base plate;

wherein the cleaning head may be used to clean the plurality of hoisting belts at once and/or the plurality of grooves of the at least one sheave at once;

wherein the upper end of the base plate is bent at an angle A with respect to the rest of the base plate, and wherein the wipers are each sandwiched between the upper end of the base plate and respective fixing plates bolted onto the upper end of the base plate so that the wipers project outwards from the base plate at the angle A.

5. The cleaning head of claim 4, wherein the angle A is about 40 to 50 degrees.

6. The cleaning head of claim 4, wherein the lower end of the base plate includes at least one open slot.

7. A cleaning head for cleaning a plurality of hoisting belts and/or at least one sheave of an elevator system, the at least one sheave including a plurality of grooves for receiving each of the hoisting belts, comprising:

a base plate; and a plurality of wipers fixed to an upper end of the base plate to project outwards from the base plate;

wherein the cleaning head may be used to clean the plurality of hoisting belts at once and/or the plurality of grooves of the at least one sheave at once;

wherein each of the wipers comprise an elastic plate and a cleaning sheet wrapped around the elastic plate.

8. The cleaning head of claim 1, wherein the at least one sheave is a drive sheave.

9. A cleaning head for cleaning a plurality of hoisting belts and/or at least one sheave of an elevator system, the at least one sheave including a plurality of grooves for receiving each of the hoisting belts, comprising:

a base plate; and a plurality of wipers fixed to an upper end of the base plate to project outwards from the base plate;

wherein the cleaning head may be used to clean the plurality of hoisting belts at once and/or the plurality of grooves of the at least one sheave at once;

wherein the at least one sheave is an idler sheave.

10. A cleaning device for cleaning a plurality of hoisting belts and/or at least one sheave of an elevator system, the at least one sheave including a plurality of grooves for receiving each of the hoisting belts, comprising:

an attachment plate which may be fixed to a machine casing;

at least one L-shaped first bracket which may be adjustably fixed to the attachment plate;

at least one L-shaped second bracket which may be adjustably fixed to the first bracket; and a cleaning head which may be fixed to the second bracket, including:

a base plate; and a plurality of wipers fixed to an upper end of the base plate to project outwards from the base plate;

wherein the cleaning head is positioned to clean the plurality of hoisting belts at once and/or the plurality of grooves of the at least one sheave at once.

11. The cleaning device of claim 10, wherein the first and second brackets are placed in alignment with the space between the plurality of hoisting belts, and the at least one second bracket extends through said space, when the cleaning device is installed in the elevator system.

12. The cleaning device of claim 11, wherein the cleaning device is installed such that the wipers project toward the inner surface of the hoisting belts to apply an adequate pressure thereon.

13. The cleaning device of claim 11, wherein the cleaning device is installed such that the wipers project toward the traction sheave to apply an adequate pressure on the bottom of each groove of the traction sheave.

14. The cleaning device of claim 10, further comprising a supporting plate fixed on the side of the cleaning head opposite the second bracket to support the cleaning head during operation.

15. The cleaning device of claim 10, wherein the first bracket includes an elongate slot for receiving at least one bolt which allows adjustment of the first bracket in a vertical direction with respect to the attachment plate.

16. The cleaning device of claim 15, wherein the second bracket includes an elongate slot for receiving at least one bolt which allows adjustment of the second bracket in a back and forth direction with respect to the first bracket.

17. A method for installing a cleaning device in an elevator system, comprising:

fixing an attachment plate and at least one L-shaped first bracket to a machine casing;

fixing at least one L-shaped second bracket to the first bracket;

fixing a cleaning head to the second bracket, the cleaning head including a base plate and a plurality of wipers fixed to an upper end of the base plate to project outwards from the base plate; and adjusting the first bracket and the second bracket so that the cleaning head applies an adequate pressure to a plurality of hoisting belts at once or to a plurality of grooves of at least one sheave at once.

18. The method of claim 17, further comprising aligning the first and second brackets with the space between the plurality of hoisting ropes and inserting the at least one second bracket through said space.

* * * * *